US005434473A

United States Patent [19]

Márton

[11] Patent Number: 5,434,473

[45] Date of Patent: Jul. 18, 1995

[54] HIGH PRESSURE SODIUM VAPOR DISCHARGE LAMP

[75] Inventor: Zsolt Márton, Budapest, Hungary

[73] Assignee: Tungsram Co., Ltd., Budapest, Hungary

[21] Appl. No.: 206,299

[22] Filed: Mar. 4, 1994

[30] Foreign Application Priority Data

Mar. 9, 1993 [HU] Hungary ..... 93 00642

[51] Int. Cl.[6] ..... H01J 17/26

[52] U.S. Cl. ..... 313/570; 313/571; 313/641; 313/642

[58] Field of Search ..... 313/570, 641, 25, 571, 313/642, 546, 490

[56] References Cited

U.S. PATENT DOCUMENTS

| | | | |
|---|---|---|---|
| 3,248,590 | 4/1966 | Schmidt | 313/570 |
| 3,781,586 | 12/1973 | Johnson | 313/570 |
| 4,260,929 | 4/1981 | Jacobs et al. | 313/570 |
| 4,801,846 | 1/1989 | Kramer et al. | 313/641 |
| 4,972,118 | 11/1990 | Yorifuji et al. | 313/490 X |
| 5,075,587 | 12/1991 | Pabst et al. | 313/25 |
| 5,150,017 | 9/1992 | Geens et al. | 313/642 X |

OTHER PUBLICATIONS

1988 Derwent Publications Ltd., Saturated Vapour High Pressure Sodium Lamp, all pages. (EP 0257830).

*Primary Examiner*—Sandra L. O'Shea

*Attorney, Agent, or Firm*—George E. Hawranko; Stanley C. Corwin

[57] ABSTRACT

This invention relates to a high pressure sodium vapor discharge lamp the discharge space of which is enclosed by a ceramic vessel having hermetically sealed ceramic end members with electric lead wires connected with electrodes inside the discharge vessel and the discharge vessel contains sodium, noble gas, mercury in a concentration of 0–5 mg/cm$^3$ and at least one further metal additive having a vapor pressure not exceeding 7.5 torr at 1000K temperature. The discharge lamp according to the invention is further characterized in that the molar fraction of sodium in the total metal additive exceeds 0.5 and the molar fraction of sodium is greater than four times the molar fraction of mercury.

7 Claims, 5 Drawing Sheets

HIGH PRESSURE SODIUM VAPOR DISCHARGE LAMP

FIELD OF THE INVENTION

This invention relates to a high pressure sodium vapor discharge lamp the discharge space of which is enclosed by a ceramic vessel having hermetically sealed ceramic end members with electrical lead wires connected with electrodes inside the discharge vessel and the discharge vessel contains sodium, noble gas, mercury in a concentration of 0–5 mg/cm$^3$ and at least one further metal additive having a vapor pressure not exceeding 7.5 torr at 1000K temperature. More particularly, this invention relates to such a lamp wherein the molar fraction of the sodium component of the fill is substantially greater than that of the mercury component.

BACKGROUND OF THE INVENTION

The operating characteristics of high pressure sodium lamps are determined by the pressure and composition of the discharge produced in the lamp. As is known, the discharge in the high pressure sodium lamps contains sodium, mercury and xenon, which have the following characteristic pressures in operation: $10^4$, $10^5$ and $3\times10^4$ Pa, respectively. An example of a typical high pressure sodium lamp can be found in U.S. Pat. No. 3,906,272 issued to Collins et al on Sep. 16, 1975 and assigned to the same assignee as the present invention. The required vapor pressures of sodium and mercury are typically ensured by a sodium-mercury amalgam with a weight ratio of 1 to 3. Upon excitation of the fill contained within the arc tube, radiation in the visible spectrum occurs. The useful radiation is for the amalgam with a weight ratio of 1 to 3. The useful radiation is for the greatest part provided by the sodium, whereas mercury has the role of increasing the voltage at the lamp terminals, thereby reducing lamp current and making current feedthroughs to be designed easier.

One of the significant factors resulting in the market popularity of high pressure sodium lamps is their long life. This long life characteristic, however, is limited by the voltage rise at lamp terminals during operation. The cause of this voltage rise is the reaction between the sodium content of the lamp and one or more components of the discharge vessel, due to which process sodium will be eliminated from the discharge over time. This effect is the so-called sodium loss that decreases the molar fraction of sodium in the sodium-mercury amalgam which, in turn, alters the sodium pressure in the discharge.

At constant temperature, sodium loss reduces the pressure of sodium which is a minor problem in itself. However, at the same time, mercury pressure increases, resulting in a greater slope in pressure relative to the increase of its molar fraction. This latter change will cause the voltage at lamp terminals to rise which will finally result in the lamp being extinguished. The above facts are well known to those proficient in the field.

It is not surprising, therefore, that several attempts have been made to solve the above problem. The state-of-the-art methods are based on the presumption that the speed of the above-mentioned sodium loss is to be slowed.

One of the approaches is aimed to reduce the speed of the chemical reaction between the discharge tube wall and sodium, and is described in a study titled "The Surface Structure of Translucent Alumina, A Scanning Electron Microscopy Investigation" by A. J. H. M. Kock (Proceedings of the Symposium on High Temperature chemistry II, p: 194–205).

Another attempt was to eliminate or reduce the contact of liquid-phase amalgam with the wall as seen in the disclosures of No. GB 2 072 939 and No. HU 181 782 Patent Specifications.

All the disclosed approaches—two of which were mentioned as examples only—have proven to be more or less successful, but have been unable to solve the problem of sodium loss. This indicates that the importance of the various factors affecting the process is still not clear.

SUMMARY OF THE INVENTION

In contrast to the earlier efforts, in devising the invention our starting point was that it is the most practical approach which recognizes the fact of sodium loss as a given condition and just strives to compensate for its effects. The invention is based on the recognition that the mercury and sodium vapor pressures prevailing in the conventional high pressure sodium lamp; designs can also be produced using the vapor pressures of even more metals with the additional advantage that when the further additives are chosen appropriately, these can stabilize the luminous efficiency and burning voltage of the plasma, even in the case of sodium loss.

In the literature reflecting the recent level of technology, several approaches are found that use, in addition to sodium and mercury, one or more further metal additives in high pressure sodium lamps. The use of such additives, however, is intended for the purpose of solving other lamp-making needs and as such, does not contribute to the solution of the sodium loss problem. E.g., for the lamp according to Patent Specification No. HU 172 011, in order to simplify the lamp manufacturing process a sodium amalgam resistant to corrosion in atmospheric conditions was prepared using a further metal component.

In U.S. Pat. No. 4,691,141 an additive dosing method is described according to which the sodium and mercury needed for lamp operation are added in the form of intermetallic compounds formed with a further metal or metals. These compounds are more stable than Na-Hg amalgam and so do not vaporize during sealing the discharge vessel with a frit in a high-temperature furnace. According to U.S. Pat. No. 3,521,108 thallium-cadmium is added with the purpose of modifying the lamp spectrum. In the disclosure of U.S. Pat. No. 4,639,639 tin, indium or gallium are described as additives, based on the consideration that these can accelerate the warm-up of the lamp and ultimately produce more favorable operating conditions for the electrodes.

An analysis of the known approaches shows the lack of recognition by anyone so far that by adding a third-/further metal/metals, a solution to the sodium loss problem can be achieved.

In choosing the third additive metal it is a consideration of fundamental importance that its vapor pressure is below $10^2$ Pa at the operating temperature of approximately 1000K, or otherwise it will appear in the discharge during operation and will modify the electrical and photometry parameters of the lamp, an effect intended to be avoided. Furthermore, the metal must not react with the lamp parts including niobium, tungsten, alumina, etc.

The important finding of the invention is that the objective—i.e., to stabilize the luminous efficiency of the plasma and the burning voltage, even in the case of sodium loss—is only achieved when the further metal/s/ are added so that two requirements are met: the molar fraction of sodium exceeds 0.5 and has a value of at least four times that of the mercury.

BRIEF DESCRIPTION OF THE DRAWINGS

In order to illustrate the finding of the invention, i.e., to show the efficient concentrations, drawing figures are attached in which.

DETAILED DESCRIPTION OF THE DRAWINGS

Figure 1:
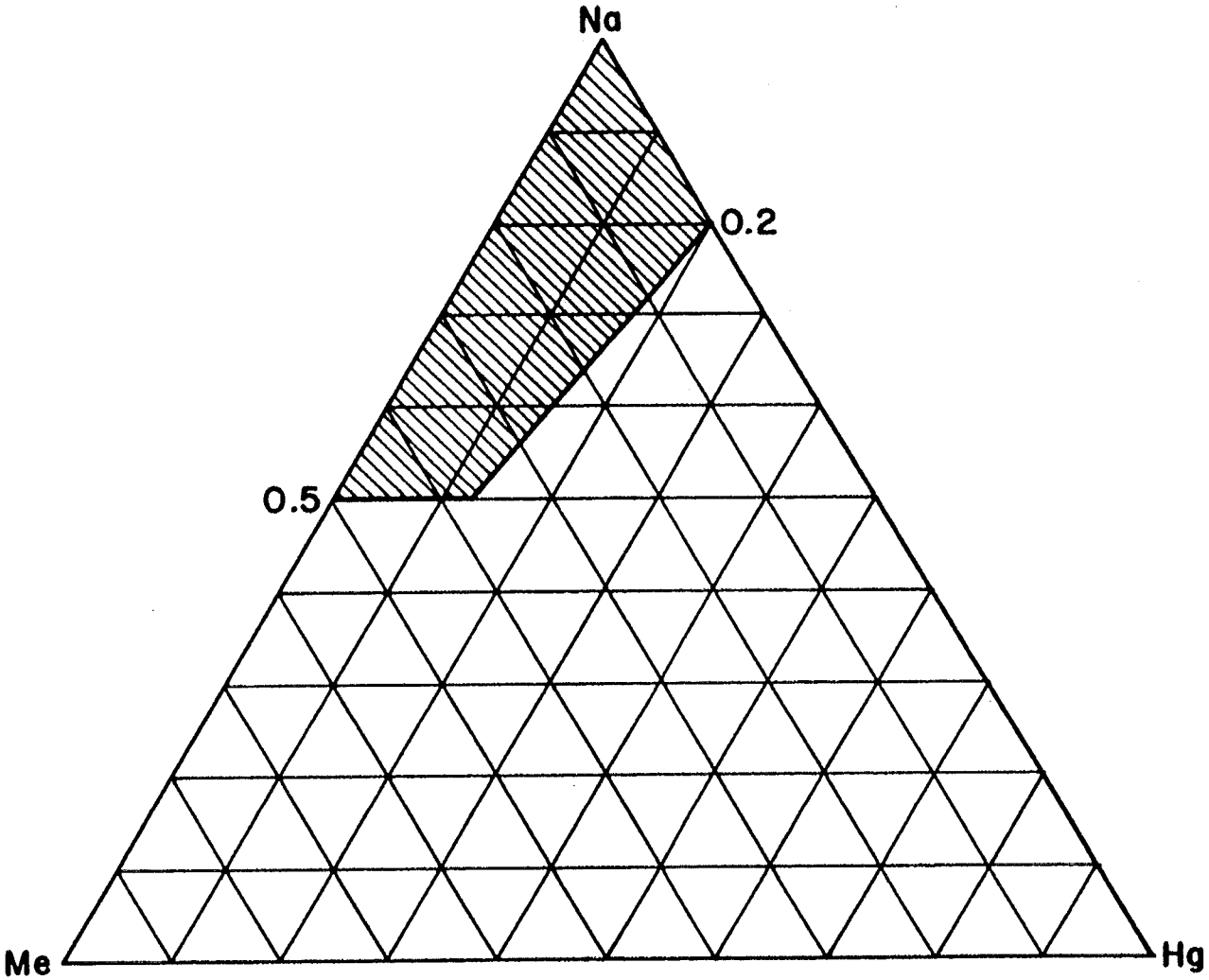
FIG. 1 is a conventional triangle diagram showing the concentration range according to the invention using an additive metal.
Figure 5:
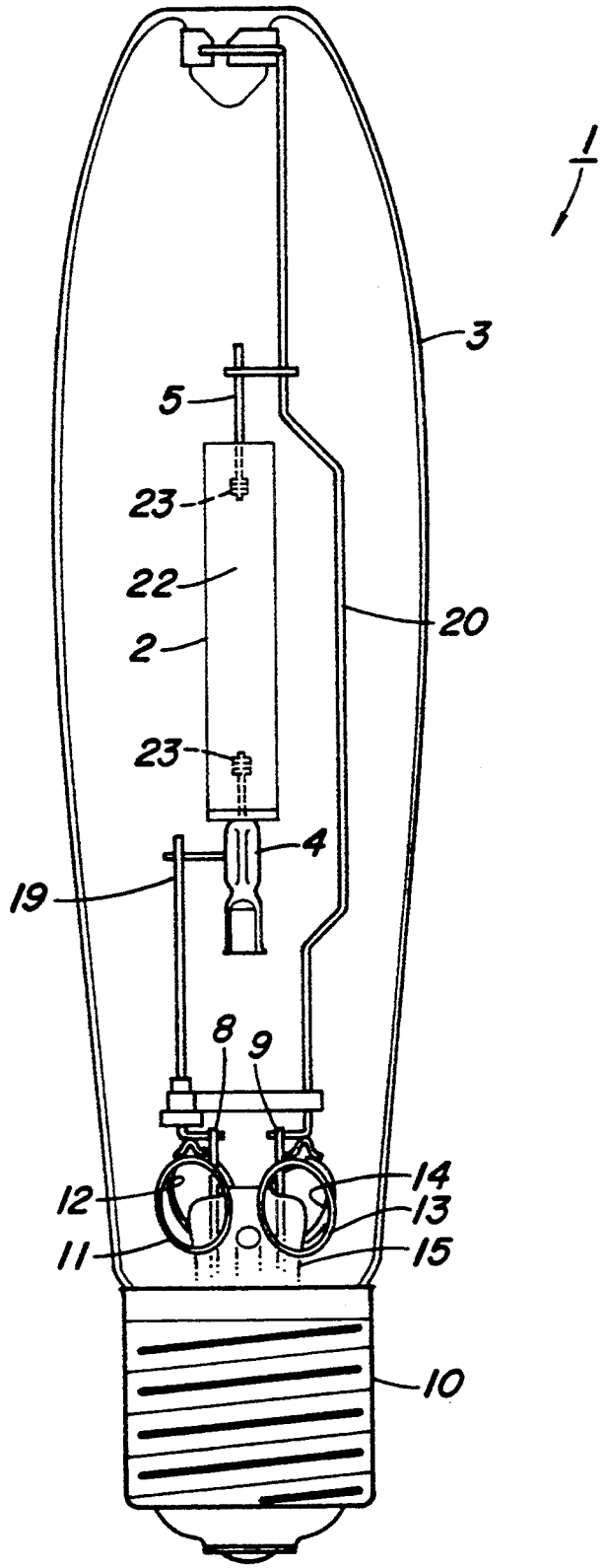
FIG. 5 is an elevational view in section of a conventional high pressure sodium discharge lamp utilizing the fill concentrations of the present invention.

As seen in FIG. 1, a graphical representation of the relative concentrations of three constituent components of the fill 22 contained in the lamp 1 shown in FIG. 5 is illustrated. Plotted along side A of the graph is the concentration of the metal additive designated generally as Me. Plotted along side B of Graph 1 is the concentration of sodium (Na) whereas plotted along side C is the concentration of mercury (Hg). As seen by the shaded area of the graph of FIG. 1, the range of concentrations are 50–100% for sodium, 0–20% for mercury and 12.5–20% for the metal additive.

Figure 2:
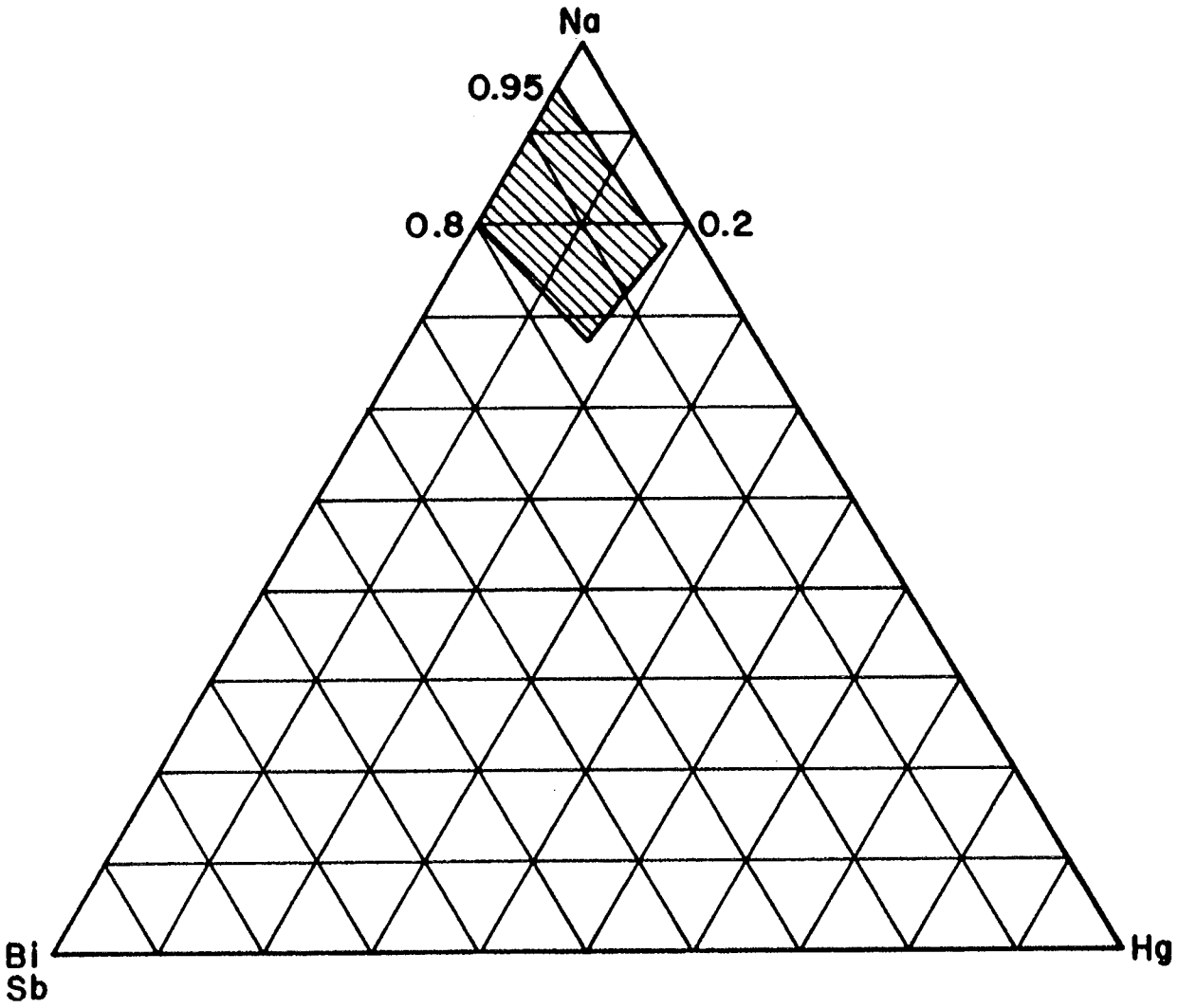
FIG. 2 is a conventional triangle diagram showing a further concentration range according to the invention where the additive metal is either bismuth or antimony.

As seen in FIG. 2, an alternate graphical plot of concentration ranges is provided wherein the additive metal is either bismuth or tin. The shaded area of FIG. 2 indicates that the range of concentrations are 80–95% for sodium, 0–19% for mercury and 5–20% for either bismuth or tin.

Figure 3:
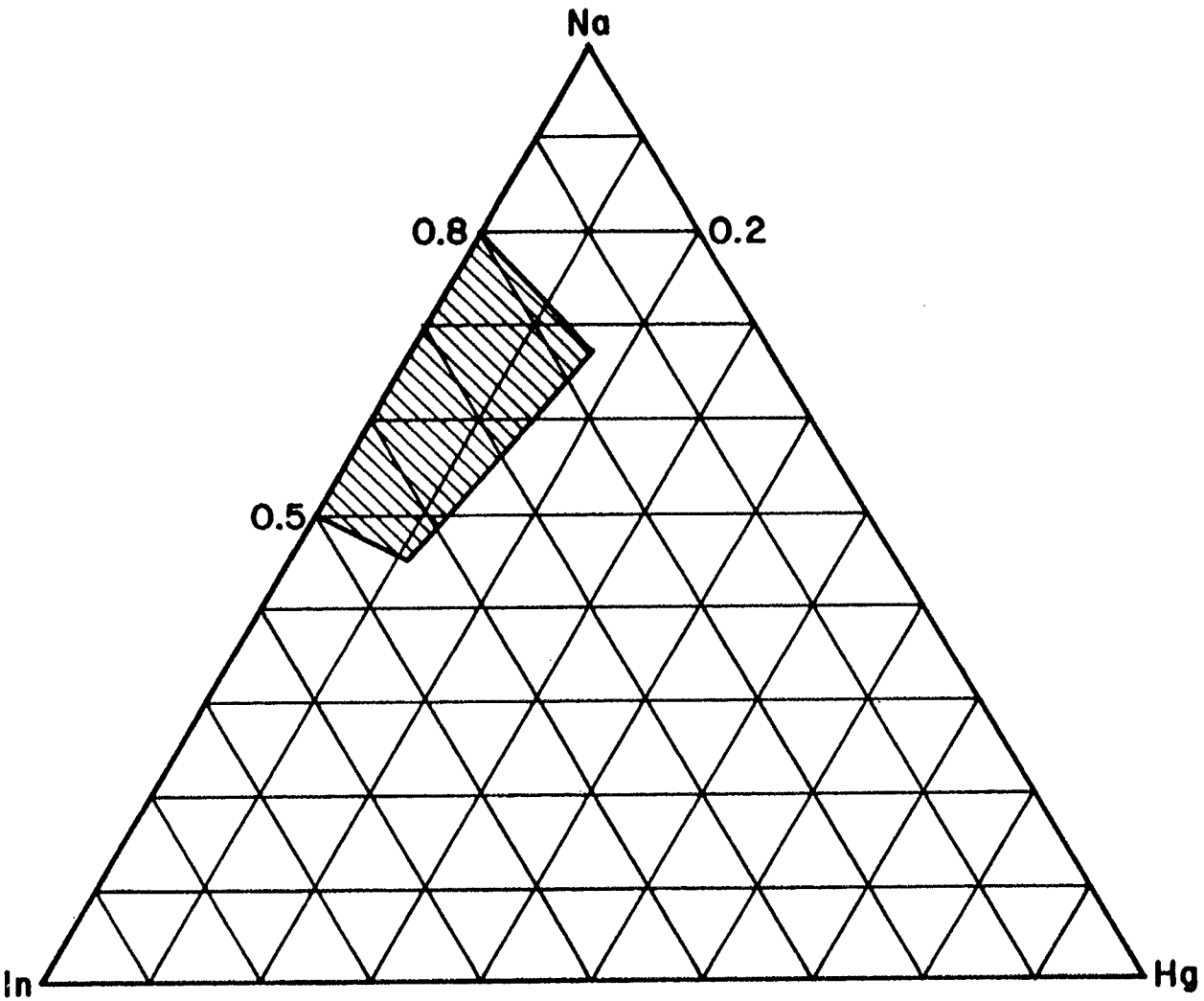
FIG. 3 is a conventional triangle diagram showing a third concentration range according to the invention where the additive metal is indium.

FIG. 3 illustrates yet another alternate arrangement of concentration ranges for the fill constituents of a high pressure sodium lamp. In this instance, the additive metal is indium and the concentration ranges are 45–80% for sodium, 12.5–17.5% for mercury, and 20–50% for indium.

Figure 4:
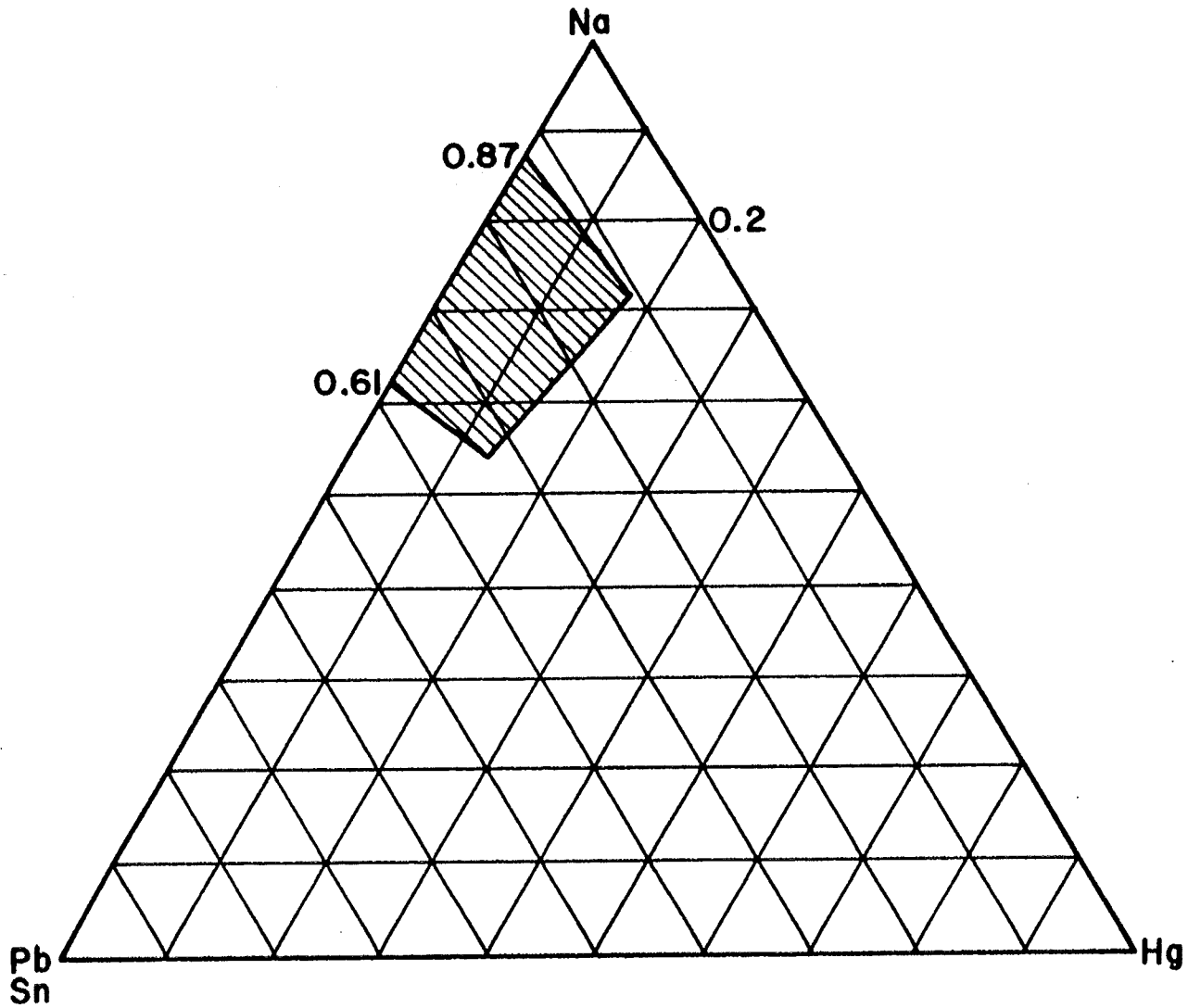
FIG. 4 is a conventional triangle diagram showing a fourth concentration range according to the invention where the additive metal is either lead or tin.

FIG. 4 illustrates one further alternate arrangement of concentration ranges wherein the additive metal is either lead (Pb) or antimony (Sn). The shaded area of this graphical representation indicates that the concentration ranges are 61–87% for sodium, 0–17.5% for mercury and 12.5–37.5% for the additive metal lead or antimony.

Of course, it can be appreciated that each point within the shaded areas of the respective graphs of FIGS. 1 through 4 represents a combination of constituents that totals 100% of the fill 22.

DETAILED DESCRIPTION OF THE INVENTION

In order to verify the solution according to the invention as described in the claims, experiments were performed that have completely confirmed our supposition. In the following the results of such an experiment will be shown as an example for the use of the invention.

"A": 4.6 mg sodium+18.4 mg mercury
"B": 2.3 mg sodium+18.4 mg mercury
"C": 4.6 mg sodium+9 mg mercury+12.5 mg indium
"D": 2.3 mg sodium+9 mg mercury+12.5 mg indium.

Version "A" represents a conventional high pressure sodium lamp, while Version "B", a sodium loss of 50%. Version "C" is an embodiment of the invention and Version "D" represents a sodium loss of the same extent as "B" does compared with "A". Obviously, the discharge tube end construction of lamps "C" and "D" had to be slightly modified to ensure that the additives are exposed to a somewhat higher operating temperature corresponding to their composition. Measurements were made on these lamps, the results of which are seen in the following Table:

| | $U_1$(V) | P(W) | Φ(kLm) | ηLm/W) |
|---|---|---|---|---|
| "A: | 90 | 239 | 27.3 | 114 |
| "B" | 124 | 273 | 30.9 | 113 |
| "C" | 88 | 232 | 26.2 | 113 |
| "D" | 110 | 264 | 30.0 | 114 |

In the Table, $U_1$ is the voltage at lamp terminals, P is the lamp wattage, Φ is the luminous flux and η is the luminous efficiency. It is seen in the Table that lamps "A" and "C" have the same data which means that lamps constructed in accordance with this invention and leaving the operating characteristics of Line C of the Table are equivalent to the conventional ones being made as shown in Line A of the Table. The results of measurements performed on lamps "B" show that with the lamp in conventional design, a sodium loss of 50% has caused a significant change in luminous and electrical parameters, e.g., the voltage at lamp terminals has increased 34 volts. At the same time, a sodium loss identical with the above has caused only 22 volt rise in lamp "C" as compared to the 34 volt rise seen between Examples "A" and "B". All these clearly show that using the finding of the invention resulted in a more stable lamp.

As seen in FIG. 5, a conventional high pressure sodium lamp 1 includes a discharge vessel 2 disposed within a transparent outer lamp envelope 3. Electrical lead wire connections 4 and 5 allow coupling of electrical energy to electrodes 23 disposed within the discharge vessel 2 so as to enable excitation of the fill 22 contained therein. Lead wire connections 4, 5 are electrically connected to the threaded screw base 10 over inlead wires 8 and 9, flashing getter rings 11, 12, 13 and 14 and support members 19 and 20. The inlead wires 8 and 9 extend through stem 15.

Although the above-described embodiments constitute the preferred embodiments, it should be understood that modifications may be made thereto without departing from the scope of the invention as set forth in the appended claims.

What is claimed is:

1. A high pressure sodium vapor discharge lamp comprising:

a ceramic vessel having a discharge space formed therein;

ceramic end members hermetically sealing said ceramic vessel;

electric leads extending through said end members;

electrodes disposed at the ends of said electric leads extend inside the discharge vessel;

the discharge vessel contains sodium, noble gas, mercury in a concentration of 0–5 mg/cm$^3$ and at least one further metal additive having a vapor pressure not exceeding 7.5 torr at 1000K temperature; and wherein the molar fraction of sodium in the total metal additive exceeds 0.5 and the molar fraction of sodium is greater than four times the molar fraction of mercury.

2. A discharge lamp according to claim 1 wherein the further metal additive consists of one or more metals selected from the metals gallium, indium, tin, lead, bismuth and antimony.

3. A discharge lamp according to claim 2 wherein the further metal additive is bismuth which has the ratio to the sodium expressed by the formula, $NaBi_x$ where x, as ratio, is between 0.05 and 0.25.

4. A discharge lamp according to claim 2 wherein the further metal additive is antimony which has the ratio to the sodium expressed by the formula, $NaSb_x$ where x, as ratio, is between 0.05 and 0.25.

5. A discharge lamp according to claim 2 wherein the further metal additive is indium which has the ratio to the sodium expressed by the formula, $NaIn_x$ where x, as ratio, is between 0.25 and 1.0.

6. A discharge lamp according to claim 2 wherein the further metal additive is lead which has the ratio to the sodium expressed by the formula, $NaPb_x$ where x, as ratio, is between 0.15 and 0.65.

7. A discharge lamp according to claim 2 wherein the further metal additive is tin which has the ratio to the sodium expressed by the formula, $NaSn_x$ where x, as ratio, is between 0.15 and 0.65.

* * * * *